US010502017B2

(12) United States Patent
Marya

(10) Patent No.: US 10,502,017 B2
(45) Date of Patent: Dec. 10, 2019

(54) SMART CELLULAR STRUCTURES FOR COMPOSITE PACKER AND MILL-FREE BRIDGEPLUG SEALS HAVING ENHANCED PRESSURE RATING

(71) Applicant: Schlumberger Technology Corporation, Sugar Land, TX (US)

(72) Inventor: Manuel P. Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 13 days.

(21) Appl. No.: 14/901,640

(22) PCT Filed: Jun. 26, 2014

(86) PCT No.: PCT/US2014/044293
§ 371 (c)(1),
(2) Date: Dec. 28, 2015

(87) PCT Pub. No.: WO2014/210283
PCT Pub. Date: Dec. 31, 2014

(65) Prior Publication Data

US 2016/0145968 A1 May 26, 2016

Related U.S. Application Data

(60) Provisional application No. 61/840,589, filed on Jun. 28, 2013.

(51) Int. Cl.

| | |
|---|---|
| ***E21B 23/06*** | (2006.01) |
| ***E21B 33/12*** | (2006.01) |
| ***E21B 33/134*** | (2006.01) |

(52) U.S. Cl.
CPC ..... *E21B 33/1208* (2013.01); *E21B 23/06* (2013.01); *E21B 33/134* (2013.01)

(58) Field of Classification Search
CPC ..... E21B 23/06; E21B 33/1208; E21B 33/134
See application file for complete search history.

(56) References Cited

U.S. PATENT DOCUMENTS 6,006,835 A 12/1999 Onan et al.
6,012,521 A * 1/2000 Zunkel ..... B09C 1/00 166/177.1

(Continued)

FOREIGN PATENT DOCUMENTS

WO WO2010127240 A1 11/2010

OTHER PUBLICATIONS

Arnaboldi, S. et al., "Functional Characterization of Shape Memory CuZnAl Open-Cell Foams by Molten Metal Infiltration", Journal of Materials Engineering and Performance, 2011, 20(4-5), pp. 544-550.

(Continued)

*Primary Examiner* — Matthew R Buck

(57) ABSTRACT

A smart device includes a scaffold that responds to an applied stimulation and an encapsulating structure that encapsulates the scaffold. The scaffold is formed from at least one smart material that responds to the applied stimulation. The encapsulating structure is formed from a material that yields to the response of the scaffold.

20 Claims, 5 Drawing Sheets

(56) References Cited

U.S. PATENT DOCUMENTS 7,743,825 B2 * 6/2010 O'Malley ..... E21B 33/1208 166/179
7,748,468 B2 7/2010 Casciaro
2008/0149345 A1 * 6/2008 Marya ..... E21B 23/00 166/376
2008/0264647 A1 * 10/2008 Li ..... E21B 17/042 166/373
2009/0084539 A1 * 4/2009 Duan ..... C08G 18/44 166/187
2009/0255675 A1 * 10/2009 Casciaro ..... E21B 33/1208 166/292
2010/0078173 A1 * 4/2010 Buytaert ..... E21B 17/1014 166/302
2010/0270031 A1 * 10/2010 Patel ..... E21B 33/1208 166/376
2011/0009979 A1 1/2011 Shaw et al.
2011/0067889 A1 * 3/2011 Marya ..... E21B 33/134 166/386
2011/0252781 A1 10/2011 Johnson et al.
2012/0090830 A1 * 4/2012 O'Malley ..... B22D 25/005 166/135
2012/0196100 A1 * 8/2012 Boyce ..... B29C 67/0051 428/212
2012/0273229 A1 * 11/2012 Xu ..... E21B 23/00 166/376
2013/0062049 A1 * 3/2013 Ren ..... B29C 44/5636 166/101
2013/0146302 A1 * 6/2013 Gaudette ..... E21B 31/002 166/376

OTHER PUBLICATIONS

Ayshford, E., "Metallic Foam Shifts Shape", in McCormick Magazine, Spring 2008, [http://magazine.mccormick.northwestern.edu/sp2008/Dunand.html], retrieved Feb. 8, 2018, 2 pages.
Phys.org, "Metal Foam Has a Good Memory", Dec. 18, 2007, [http://www.physorg.com/news117214996.html] retrieved Feb. 8, 2018, 3 pages.
The Minerals, Metals & Materials Society, Photo, [http://www.tms.org/pubs/journals/JOM/0012/fig2c.gif], retrieved Feb. 8, 2018, 1 page.
Wikipedia, "Smart Material", Dec. 6, 2017, [http://en.wikipedia.org/wiki/Smart_material], retrieved Feb. 8, 2018, 2 pages.
Search Report and Written Opinion of International Application No. PCT/US2014/044293 dated Oct. 20, 2014, 12 pages.

* cited by examiner

SMART CELLULAR STRUCTURES FOR COMPOSITE PACKER AND MILL-FREE BRIDGEPLUG SEALS HAVING ENHANCED PRESSURE RATING

CROSS-REFERENCE TO RELATED APPLICATIONS

This application is a non-provisional patent application of U.S. Provisional Patent Application Ser. No. 61/840,589, filed on Jun. 28, 2013, and entitled: "SMART CELLULAR STRUCTURES FOR COMPOSITE PACKER & MILL-FREE BRIDGEPLUG SEALS HAVING ENHANCED PRESSURE RATING." Accordingly, this non-provisional patent application claims priority to U.S. Provisional Patent Application Ser. No. 61/840,589 under 35 U.S.C. § 119(e). U.S. Provisional Patent Application Ser. No. 61/840,589 is hereby incorporated in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

Production components sometimes include production tubing that run along the length of the wellbore or casing. The diameter of the production tubing is smaller than that of the wellbore or casing. It is sometimes useful to create a seal between the production tubing and the wellbore or casing to prevent fluids and gasses from running along the length of the well between the production tubing and wellbore or casing. A packer is used to create a seal between production tubing and a wellbore or casing. A packer is a device that expands to fill the space between production tubing and a wellbore or casing.

During production of hydrocarbon fluids from a well, it may be useful to temporarily isolate different zones of a well. Zones are linear sections of a well that may be at different depths. A bridgeplug is a tool used to isolate zones by completely filling a small section of well. Bridgeplugs prevent fluids and gasses from traversing along the length of the well by expanding to create a seal between sections of the well above and below the bridgeplug.

Some bridgeplugs and packers can seal once and are removed by mechanical milling after sealing. Other bridgeplugs and packers are reversible and may seal and unseal.

SUMMARY

In general, in one aspect, a smart device includes a scaffold that responds to an applied stimulation and an encapsulating structure that encapsulates the scaffold.

In general, in one aspect, a smart device includes a scaffold that responds to an applied stimulation and an encapsulating structure that encapsulates the scaffold and yields to the response of the scaffold.

In general, in one aspect, a method of operating a smart device includes applying a stimulation to a scaffold, responding to the stimulation by the scaffold, and yielding to the response of the scaffold by an encapsulating structure.

Other aspects and advantages of the disclosure will be apparent from the following description and the appended claims.

BRIEF DESCRIPTION OF DRAWINGS

Certain embodiments of the disclosure will hereafter be described with reference to the accompanying drawings. It should be understood, however, that the accompanying drawings illustrate the various implementations described herein and are not meant to limit the scope of various technologies described herein. The drawings show and describe various embodiments of the current disclosure.

DETAILED DESCRIPTION

Specific embodiments will now be described in detail with reference to the accompanying figures. Numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect," "connection," "connected," "in connection with," and "connecting" are used to mean "in direct connection with" or "in connection with via one or more elements;" and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and downwardly," "upstream" and "downstream;" "above" and "below;" and other like terms indicating relative positions above or below a given point or element are used in this description to more clearly describe some embodiments of the disclosure.

Embodiments may take the form of metallic scaffolds, such as foams, having smart alloys or ceramics. These may be used for non-mechanical/non-hydraulic set downhole zone isolation tools such as packers and bridgeplugs. In some embodiments, the scaffolds may provide greater pressure ratings and enable mill-free, self-degradation.

Figure 1:
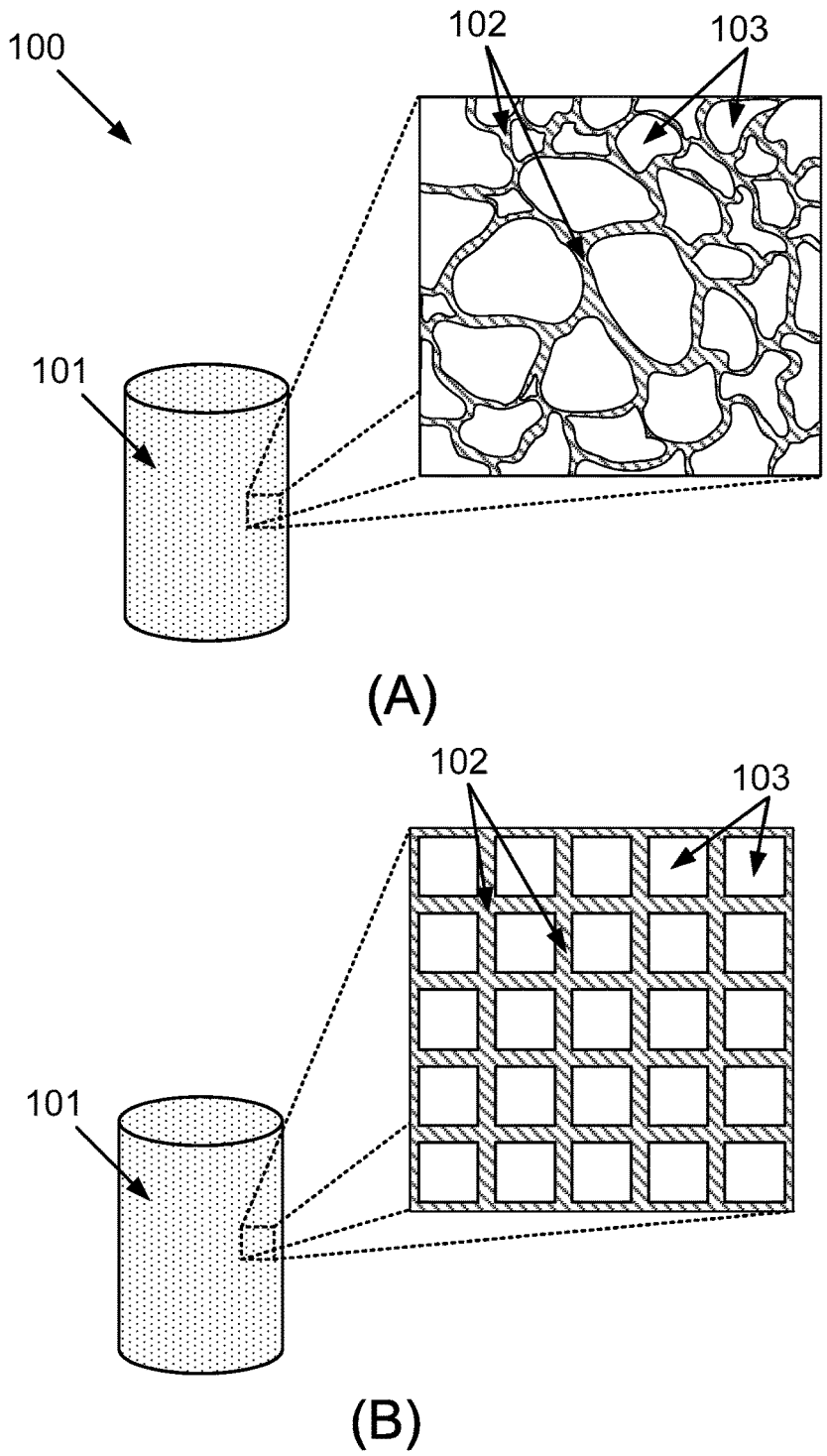
FIGS. 1(A) and (B) show a smart device in accordance with one or more embodiments.

In accordance with one or more embodiments, a 3D scaffold of a smart and strong material (e.g., a foam) is infiltrated with a deformable elastomeric material (e.g., an elastomer or a swellable rubber). The scaffold may take the form of relatively large cells of smart materials (e.g., electrostrictive, magnetostrictive or degradable alloy/ceramic) that may be actuated (e.g. expanded, contracted, etc.) using thermal, electrical, magnetic, or chemical means to seal. In some embodiments, the scaffold is formed by additive manufacturing (e.g., 3D laser printing), powder metallurgy, or casting combined with leaching FIG. 1 shows a device (100) in accordance with one or more embodiments. More specifically, FIG. 1 shows a smart device (101). The smart device (101) includes a scaffold (102) and an encapsulating structure (103). Two example embodiments of the scaffold (102) are shown in FIGS. 1(A) and 1(B) respectively.

In FIG. 1(A), the scaffold (102) is open-cell foam. The open-cell foam contains a network of pores that create passageways through the foam. The pores are randomly distributed. The distribution of the pores in the foam is controlled so that the lattice will respond to a stimulation.

In FIG. 1(B), the scaffold (102) is a structured lattice. The structured lattice contains a network of passageways through the lattice. The location of each passageway in the lattice is designed so that the lattice will respond in a predetermined way to stimulation. In one or more embodiments, the structured lattice is produced by additive manufacturing. Additive manufacturing is a manufacturing process that adds additional material to a structure. For example, inkjet printing is a form of additive manufacturing that adds ink to paper to form letters and symbols. Neither ink nor paper is removed as part of the process. In contrast, subtractive manufacturing is a manufacturing process that removes material from a structure. For example, mechanical milling is a subtractive manufacturing process that removes material from a structure. In one or more embodiments, the structured lattice is produced by three dimensional printing. In one or more embodiments, the three dimensional printing method is laser sintering or laser melting of a powder. In one or more embodiments, the structured lattice is produced by a combination of casting and subsequent leaching In another embodiment, the structured lattice is produced by powder metallurgy which includes filling a form with a powdered metal or slurry and then heating until the powdered metal or slurry is sintered into a continuous solid structure.

In accordance with one or more embodiments, the scaffold (102) is formed from at least one of an electrostrictive material, magnetostrictive material, shape-memory alloy, shape-memory polymer, chemically responsive material, halochromic material, chromogenic material, ferrofluid, photomechanical material, piezoelectric material, self-healing material, degradable material, or a thermoelectric material. Each of the aforementioned materials are smart materials that undergo a change when exposed to a stimulation. Electrostrictive materials undergo a change when exposed to an applied electric charge, electric current, or electric flux. For example, an electrostrictive material may change shape when exposed to an applied voltage. Magnetostrictive materials undergo a change when exposed to an applied magnetic flux. Shape-memory alloys and shape-memory polymers undergo a change when exposed to a temperature. For example, a shape-memory material may change shape when exposed to a temperature. Chemically responsive materials undergo a change when exposed to chemicals. Halochromic materials change color in response to acidity level. Chromogenic materials change color in response to electrical, optical, or thermal changes. Ferrofluids become strongly magnetized when exposed to a magnetic field. Photomechanical materials change shape when exposed to light. Piezoelectric materials produce a voltage when exposed to strain or the reverse. Strain may be applied to a piezoelectric material by an applied pressure. Self-healing materials repair themselves when exposed to stimulation such as the passage of time. Degradable materials degrade when exposed to stimulation. Thermoelectric materials produce a voltage in response to a temperature difference or the reverse.

In accordance with one or more embodiments, the scaffold (102) is lead magnesium niobate, lead magnesium niobate-lead titanate, or lead lanthanum zirconate titanate. In one or more embodiments, the scaffold (102) is copper zinc aluminum shape memory alloy, nickel tin alloy, copper aluminum nickel alloy, silver cadmium alloy, gold cadmium alloy, copper tin alloy, copper zinc alloy, indium titanium alloy, nickel aluminum alloy, iron platinum alloy, manganese copper alloy, or iron manganese silicon alloy. In another embodiment, the scaffold (102) is a degradable alloy primarily composed of aluminum that degrades when exposed to an environment, e.g. a well or a body of water.

In accordance with one or more embodiments, the scaffold (102) is formed from a number of different smart materials. The combination of smart materials results in a scaffold (102) that responds to many different forms of stimulation. For example, a scaffold (102) may contain a thermoelectric material that produces a voltage in response to an applied temperature difference and a piezoelectric material that produces a charge in response to an applied strain. The produced voltage and charge in some cases may be used to sense the ambient conditions around the smart device (101) which may subsequently be sent to a monitor. In another embodiment, the scaffold (102) may contain a first smart material that responds to a first stimulation which creates a second stimulation to which a second smart material responds. For example, the scaffold (102) may contain piezoelectric material that creates a charge in response to an applied strain. The scaffold (102) may further contain thermoelectric material that creates a temperature difference in response to the charge created by the piezoelectric material. In another example, the scaffold (102) may contain a first piezoelectric material that creates a charge in response to an applied strain due to an applied pressure. The scaffold (102) further contains a second piezoelectric material that accepts the charge created by the first piezoelectric material. The second piezoelectric material generates an internal strain in response to the accepted charge which results in the scaffold (102) changing shape.

The scaffold (102) is encapsulated by an encapsulating structure (103). The encapsulating structure (103) surrounds the entire scaffold (102) and fills any unoccupied space within the scaffold (102). The encapsulating structure material yields to the response of the scaffold (102) when the scaffold (102) is stimulated. In one or more embodiments, the encapsulating structure (103) material is an elastomeric material, an elastomer, or a swellable rubber. In one or more embodiments, the encapsulating structure (103) material is pliable and when pressed against a structure is able to conform to the structure to form a seal.

In accordance with one or more embodiments, the smart device (101) is produced by infiltrating the scaffold (102) with a material that is a fluid or a gel. After infiltration, the fluid or gel sets and forms an encapsulating structure (103) around the scaffold (102).

Figure 2:
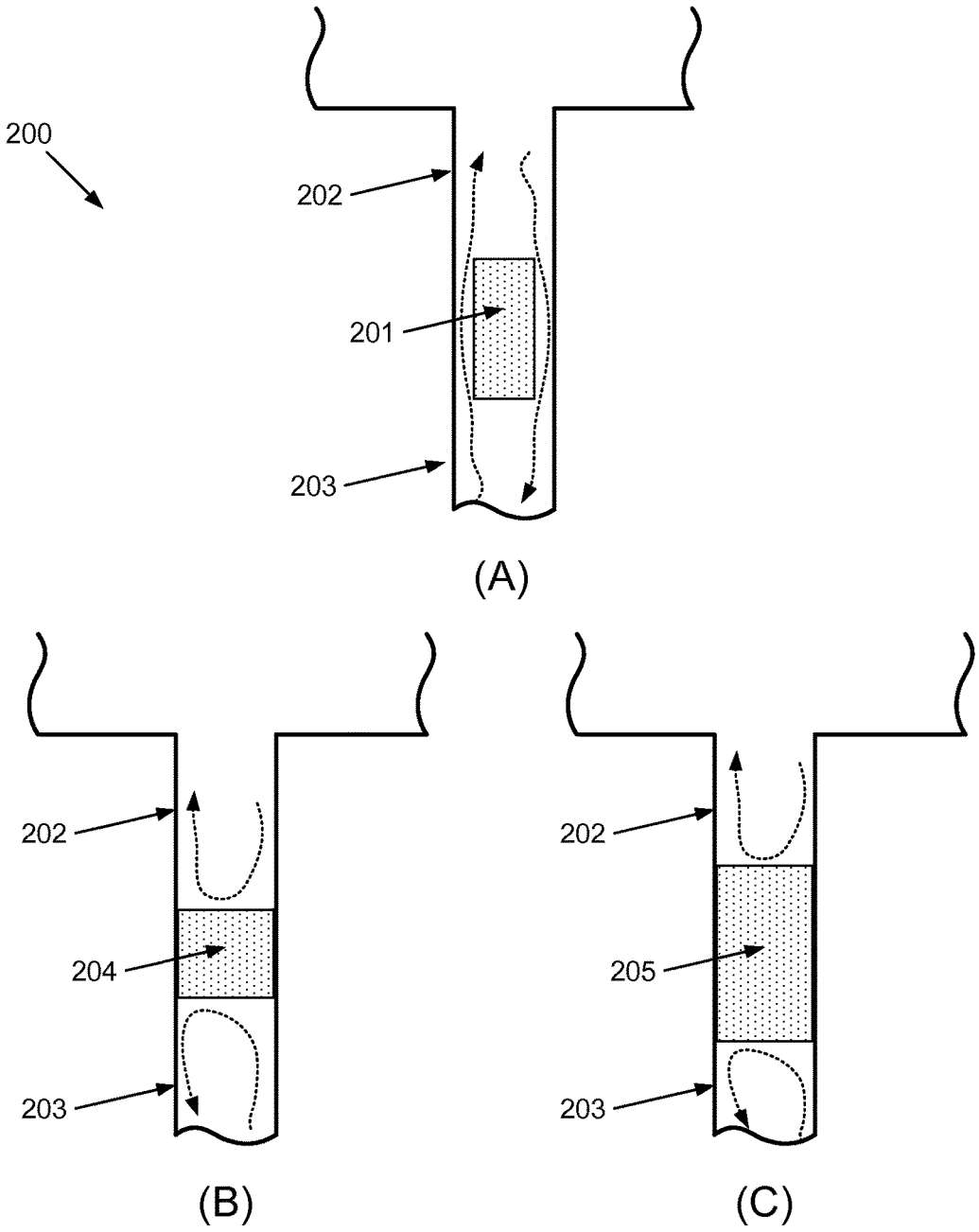
FIG. 2(A)-(C) show responses of a smart device in accordance with one or more embodiments.

In accordance with one or more embodiments, FIG. 2 illustrates two example responses of a smart device (201). More specifically, FIG. 2(A) shows a smart device (201) that has been placed in a well. The well has a first zone (202) and a second zone (203). Under normal conditions, the diameter of the smart device (201) is smaller than the diameter of the well which allows fluids and gasses to traverse the well. Fluid and gas traversal along the length of the well has been indicated by arrows with a dashed tail.

FIG. 2(B) illustrates a response of smart device (204) containing a scaffold (102) due to an applied stimulation. The scaffold (102) contracted along the length of the well and expanded across the width of the well in response to an applied stimulation. The encapsulating structure (103) yielded to the expansion and contraction of the scaffold (102). The expansion of the smart device (204) along the width of the well created a seal along the wellbore or casing. Fluid and gas in the first zone (202) and the second zone (203) are prevented from traversing past the smart device (204) along the length of the well as indicated by the arrows with dashed tails.

FIG. 2(C) illustrates a second response of a smart device (205) containing a scaffold (102) due to an applied stimulation. The scaffold (102) has expanded along the length of the well and expanded across the width of the well. The encapsulating structure (103) yielded to the expansion of the scaffold (102). The expansion of the smart device (205) along the width of the well created a seal along the wellbore or casing. Fluid and gas in the first zone (202) and the second zone (203) are prevented from traversing past the smart device (205) along the length of the well as indicated by the arrows with dashed tails.

The scaffolds (102) of the smart devices (201) illustrated in FIG. 2(B) and (C) respond by changing shape in response to stimulation. In one example, the scaffolds (102) contain an electrostrictive material that expands or contracts depending on an applied voltage. In another example, the scaffolds (102) may contain a magnetostrictive material that expands or contracts depending on an applied magnetic flux. In a further example, the scaffolds (102) may contain a shape-memory alloy that changes shape in response to an applied temperature.

Figure 3:
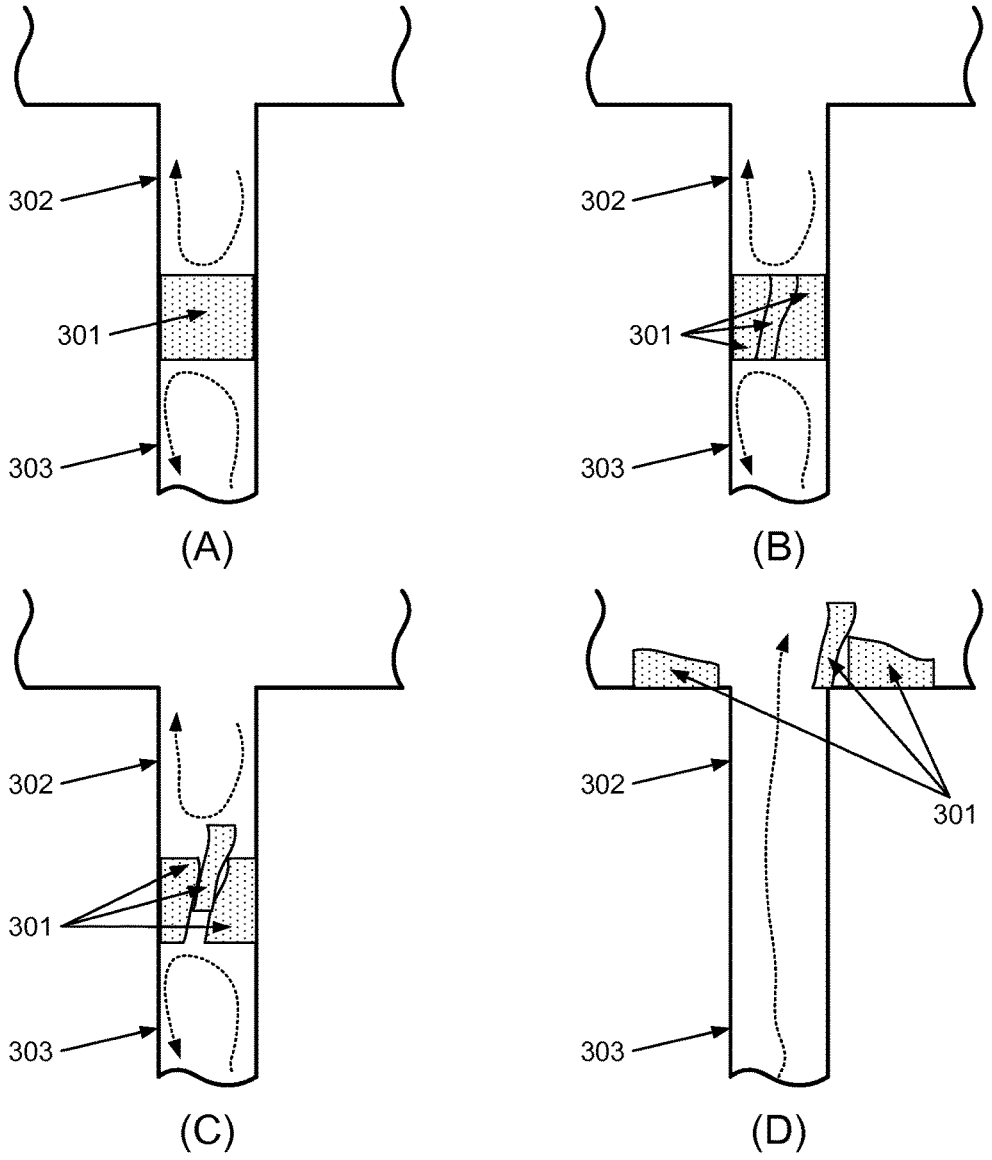
FIG. 3(A)-(D) show a response of a smart device in accordance with one or more embodiments.

In accordance with one or more embodiments, FIG. 3 illustrates the response of a smart device (301). More specifically, FIG. 3(A) shows a smart device (301) that has been placed in a well. The well has a first zone (302) and a second zone (303). The scaffold (102) of the smart device (301) contains an smart material that has responded to an applied stimulation and sealed the well which has separated a first zone (302) from a second zone (303). The scaffold (102) also contains a degradable material that breaks down after a predetermined amount of time when exposed to the well environment.

FIG. 3(B) illustrates the beginning of the breakdown of the scaffold (102) within the smart device (301). As the smart device (301) is exposed to the well environment, the scaffold (102) begins to degrade and pieces of the scaffold (102) begin to disintegrate or break away from the smart device (301). For example, the scaffold (102) may contain an aluminum based alloy that reacts with the fluids in the local well environment which dissolves or damages the alloy and results in the scaffold (102) breaking down. The superimposed black lines over the smart device (301) in FIG. 3(B) indicate the breakdown of the scaffold (102).

FIG. 3(C) illustrates that once the scaffold (102) of the smart device (301) degrades to a sufficient level, the structural integrity of the smart device (301) is compromised and beings to break down. In FIG. 3(C), the smart device (301) breakdown is illustrated as the smart device (301) breaking into 3 pieces. Breaking down into 3 pieces is merely an illustration. The smart device (301) may break apart into any number of pieces or pieces may break away from the smart device (301) sequentially.

FIG. 3(D) illustrates the smart device (301) after breaking into pieces and removal from the well. Isolation between the first zone (302) and second zone (303) is eliminated by breaking down the smart device (301). Fluid and gas in the first zone (302) and the second zone (303) traverse between the zones without restriction as indicated by the arrows with dashed tails.

Figure 4:
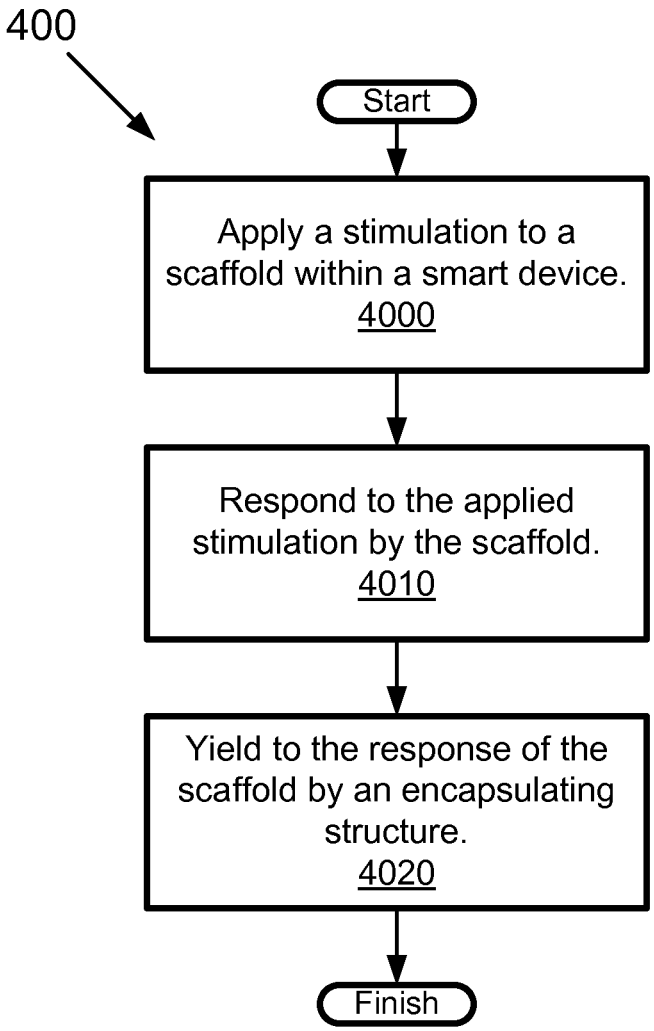
FIG. 4 shows a flow chart of a method in accordance with one or more embodiments.

FIG. 4 shows a flowchart (400) in accordance with one or more embodiments. The method depicted in FIG. 4 may be used to operate the smart device (101). One or more parts shown in FIG. 4 may be omitted, repeated, and/or performed in a different order among different embodiments. Accordingly, embodiments should not be considered limited to the specific number and arrangement shown in FIG. 4.

Initially, at 4000, a stimulation is applied to a scaffold (102) within a smart device (101). In 4010, the scaffold (102) responds to that scaffold, e.g. changing shape, degrading, etc. In 4020, an encapsulating structure (103) yield to the response of the scaffold (102), e.g. changing shape, transmitting charge, etc.

Figure 5:
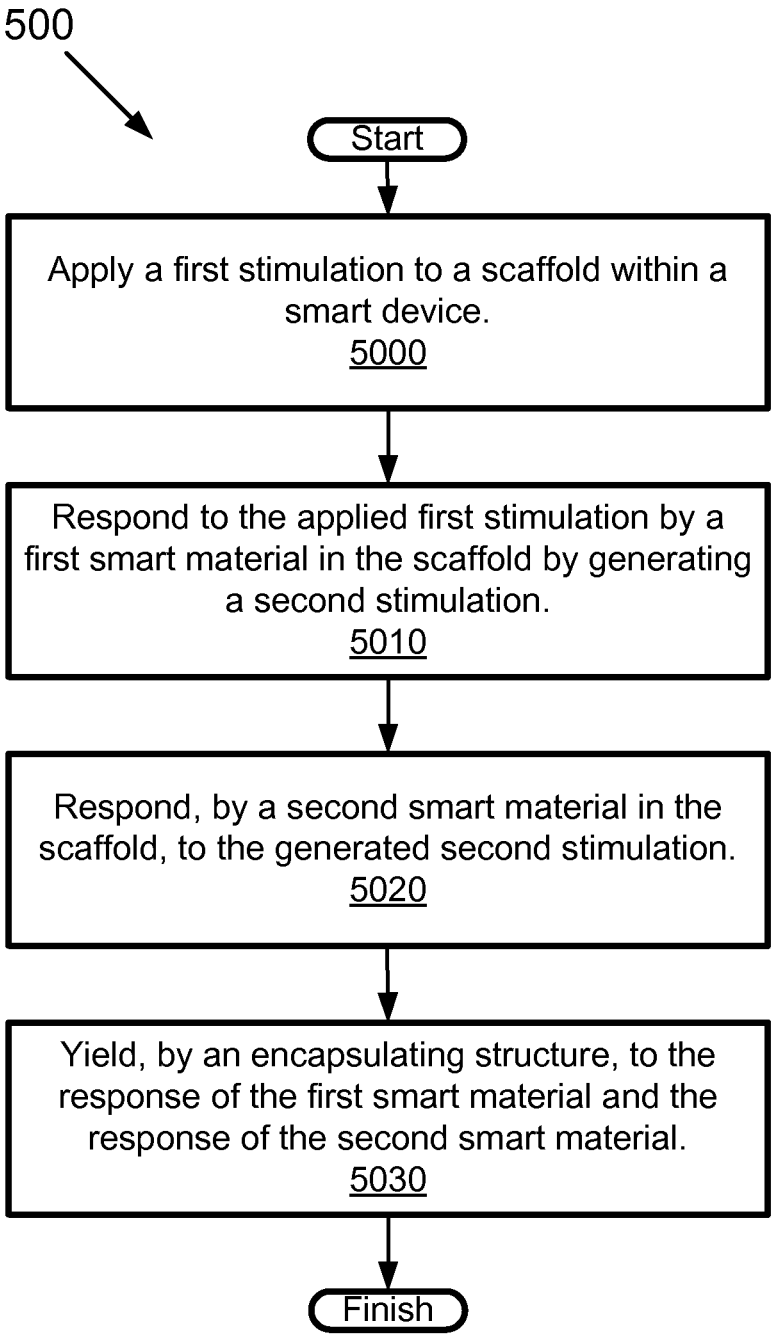
FIG. 5 shows a flow chart of a method in accordance with one or more embodiments.

FIG. 5 shows a flowchart (500) in accordance with one or more embodiments. The method depicted in FIG. 5 may be used to operate the smart device (101). One or more parts shown in FIG. 5 may be omitted, repeated, and/or performed in a different order among different embodiments. Accordingly, embodiments should not be considered limited to the specific number and arrangement shown in FIG. 5.

Initially, at 5000, a first stimulation is applied to a scaffold (102) within a smart device (101). In 5010, a first smart material in the scaffold (102) responds to the first stimulation by generating a second stimulation. In 5020, a second smart material in the scaffold (102) responds to the second stimulation. In 5030, an encapsulating structure (103) yields to the response the first smart material and response of the second smart material.

Although the preceding description has been described herein with reference to particular means, materials, and embodiments, it is not intended to be limited to the particulars disclosed herein; rather it extends to functionally equivalent structures, methods, and uses, such as are within the scope of the appended claims.

What is claimed is:

1. A smart device comprising:

a scaffold configured to respond to an applied stimulation; and an encapsulating structure that encapsulates the scaffold and is configured to yield to the response of the scaffold to form a well fluid seal, wherein the encapsulating structure surrounds an entirety of the scaffold, wherein the encapsulating structure fills any unoccupied space within the scaffold, wherein the scaffold comprises a degradable alloy, primarily composed of aluminum, that degrades the well fluid seal after a predetermined amount of time when exposed to well fluid, wherein the stimulation applied to the scaffold is one selected from the group consisting of: electric charge; electric current; electric flux; magnetic flux; temperature;

chemical exposure; light exposure; and strain.

2. The device of claim 1, wherein the scaffold is open-cell foam.

3. The device of claim 1, wherein the scaffold is formed from at least one material selected from the group consisting of: electrostrictive materials, magnetostrictive materials, shape-memory alloys, shape-memory polymers, chemically responsive materials, halochromic materials, chromogenic materials, ferrofluids, photomechanical materials, piezoelectric materials, and self-healing.

4. The device of claim 1, wherein the scaffold is formed from at least one material selected from the group consisting of: lead magnesium niobate, lead magnesium niobate-lead titanate, and lead lanthanum zirconate titanate.

5. The device of claim 1, wherein the scaffold is formed from at least one material selected from the group consisting of: copper zinc aluminum shape memory alloy, Nickel Tin alloy, Copper Aluminum Nickel alloy, Silver Cadmium alloy, Gold Cadmium alloy, Copper Tin alloy, Copper Zinc alloy, Indium Titanium alloy, Nickel Aluminum alloy, Iron Platinum alloy, Manganese Copper alloy, and Iron Manganese Silicon alloy.

6. The device of claim 1, wherein the scaffold is produced by additive manufacturing.

7. The device of claim 1, wherein the scaffold is produced by a combination of metal casting and leaching.

8. The device of claim 1, wherein the response of the scaffold is one selected from the group consisting of: isotropic change in size, anisotropic change in size, production of charge, change of color, change of temperature, and change of opacity.

9. The device of claim 1, wherein the encapsulating structure is formed from a material selected from the group consisting of: an elastomeric material, an elastomer, and a swellable rubber.

10. The device of claim 1, wherein the smart device is configured as a well completion component, and wherein the response of the scaffold to the applied stimulation causes the well completion component to form the well fluid seal between production tubing and a wellbore or casing.

11. A method of operating a smart device, the method comprising:

applying a stimulation to a scaffold of the smart device, wherein the stimulation causes a scaffold response, wherein the stimulation applied to the scaffold is one selected from the group consisting of: electric charge; electric current; electric flux; magnetic flux; temperature; chemical exposure; light exposure; and strain, wherein the smart device comprises an encapsulating structure that encapsulates the scaffold, wherein the encapsulating structure surrounds an entirety of the scaffold, wherein the encapsulating structure fills any unoccupied space within the scaffold, and wherein the scaffold of the smart device comprises a degradable alloy, primarily composed of aluminum, that degrades responsive to exposure to well fluid;

yielding the encapsulating structure to the response of the scaffold to form a well fluid seal; and degrading the well fluid seal after a predetermined amount of time by exposing the degradable alloy of the scaffold of the smart device to well fluid.

12. The method of claim 11, wherein the scaffold is open-cell foam.

13. The method of claim 11, wherein the scaffold is formed from at least one material selected from the group consisting of: electrostrictive materials, magnetostrictive materials, shape-memory alloys, shape-memory polymers, chemically responsive materials, halochromic materials, chromogenic materials, ferrofluids, photomechanical materials, piezoelectric materials, and self-healing materials.

14. The method of claim 11, wherein the scaffold is formed from at least one material selected from the group consisting of: lead magnesium niobate, lead magnesium niobate-lead titanate, and lead lanthanum zirconate titanate.

15. The method of claim 11, wherein the scaffold is formed from at least one material selected from the group consisting of: copper zinc aluminum shape memory alloy, nickel tin alloy, copper aluminum nickel alloy, silver cadmium alloy, gold cadmium alloy, copper tin alloy, copper zinc alloy, indium titanium alloy, nickel aluminum alloy, iron platinum alloy, manganese copper alloy, and iron manganese silicon alloy.

16. The method of claim 11, wherein the scaffold is produced by additive manufacturing.

17. The method of claim 11, wherein the scaffold is produced by a combination of metal casting and leaching.

18. The method of claim 11, wherein the response of the scaffold is one selected from the group consisting of: isotropic change in size, anisotropic change in size, production of charge, change of color, change of temperature, and change of opacity.

19. The method of claim 11, wherein the encapsulating structure is formed from a material selected from the group consisting of: an elastomeric material, an elastomer, and a swellable rubber.

20. The method of claim 11, wherein the smart device is configured as a well completion component, and wherein the responding to the applied stimulation by the scaffold causes the well completion component to form the well fluid seal between production tubing and a wellbore or casing.

* * * * *